US011408409B2

(12) United States Patent
Kuang

(10) Patent No.: US 11,408,409 B2
(45) Date of Patent: Aug. 9, 2022

(54) AUTOMOBILE INFLATABLE PUMP

(71) Applicant: GUANGZHOU ANTU ELECTRIC CO., LTD., Guangdong (CN)

(72) Inventor: Xinhua Kuang, Guangdong (CN)

(73) Assignee: GUANGZHOU ANTU ELECTRIC CO., LTD., Guangzhou (CN)

( * ) Notice: Subject to any disclaimer, the term of this patent is extended or adjusted under 35 U.S.C. 154(b) by 110 days.

(21) Appl. No.: 16/868,519

(22) Filed: May 6, 2020

(65) Prior Publication Data

US 2021/0262459 A1 Aug. 26, 2021

(30) Foreign Application Priority Data

Feb. 21, 2020 (CN) ..... 202010110455.4

(51) Int. Cl.

| | |
|---|---|
| ***F04B 35/01*** | (2006.01) |
| ***F04B 53/14*** | (2006.01) |
| ***F04B 35/04*** | (2006.01) |
| ***F04B 39/00*** | (2006.01) |
| ***F04B 39/04*** | (2006.01) |
| ***F04B 39/10*** | (2006.01) |

(52) U.S. Cl.

CPC ..... *F04B 35/01* (2013.01); *F04B 35/04* (2013.01); *F04B 39/0005* (2013.01); *F04B 39/0016* (2013.01); *F04B 39/042* (2013.01); *F04B 39/1033* (2013.01); *F04B 53/143* (2013.01)

(58) Field of Classification Search

CPC ..... F04B 35/04; F04B 41/02; F04B 35/01; F04B 53/143; F04B 39/1033; F04B 39/0016; F04B 39/042; F04B 39/0005; F16J 9/00; F16J 9/02; F16J 9/206; F15B 15/1452

See application file for complete search history.

(56) References Cited

U.S. PATENT DOCUMENTS 6,514,058 B1 * 2/2003 Chou ..... F04B 39/0016 417/313
2007/0292282 A1 * 12/2007 Schuetzle ..... H02J 7/0063 417/273
2008/0240943 A1 * 10/2008 Wang ..... F04B 39/0016 417/361
2021/0062489 A1 * 3/2021 Gilde ..... E03D 5/024

FOREIGN PATENT DOCUMENTS

JP 09014141 A * 1/1997 ..... F04B 39/0016

* cited by examiner

*Primary Examiner* — Essama Omgba
*Assistant Examiner* — Christopher J Brunjes

(57) ABSTRACT

The invention relates to an automobile inflatable pump comprising: a driving assembly; a rocker arm, a rear end of which is mounted on a power output end of the drive assembly; a cylinder block connected to the drive assembly and defining a piston cavity inside; a piston provided on a front end of the rocker arm, the piston being movably received in the piston cavity to divide the piston cavity into a front cavity having an inflation inlet and a rear cavity communicating with the external environment, the drive assembly driving the rocker arm to rotate, thus the piston moves back and forth in a straight line; and a sealing ring provided in the first annular groove, a front end of the sealing ring protruding at least in part beyond the outer peripheral wall of the piston. The invention has beneficial effects of simplified structure, improved production efficiency, and reduced costs.

14 Claims, 6 Drawing Sheets

AUTOMOBILE INFLATABLE PUMP

CROSS REFERENCE TO RELATED APPLICATIONS

The present application claims the benefit of Chinese Patent Application No. 202010110455.4 filed on Feb. 21, 2020, the contents of which are incorporated herein by reference in their entirety.

FIELD OF THE INVENTION

The invention relates to the field of auto parts, in particular to an automobile inflatable pump.

BACKGROUND OF THE INVENTION

At present, it is necessary to the piston of an automobile inflatable pump to adopt a two-way seal structure, usually including a sealing ring and a valve disc. The sealing ring is sleeved on the outer periphery of the piston, and is used to achieve seal between the piston and an inside wall of the cylinder block. The valve disc is arranged at the air inlet hole in a front end surface of the piston, and is used to control opening and closing of the air inlet duct of piston. This structure requires multiple processes to manufacture and assemble, so that the production cost is high. The valve disc is prone to failure, so that the structure has poor reliability.

SUMMARY OF THE INVENTION

An objective of the invention is to provide an automobile inflatable pump to overcome the shortcomings of the prior art, which can simplify the sealing structure of the piston, thereby reducing the cost and improving operational reliability.

In order to achieve the above objective, the invention provides an automobile inflatable pump which comprises:

a drive assembly;

a rocker arm, a rear end of which is mounted on a power output end of the drive assembly;

a cylinder block connected to the drive assembly, a piston cavity being defined within the cylinder block;

a piston provided on a front end of the rocker arm, the piston being movably received in the piston cavity to divide the piston cavity into a front cavity having an inflation inlet and a rear cavity communicating with external environment, the drive assembly driving the rocker arm to rotate so that the piston moves back and forth in a straight line, an outer periphery of the piston being provided with a first annular groove, a first sealing surface being defined in a rear end surface of the first annular groove, and a front end surface of the piston being provided with air inlet holes communicating with the first annular groove; and a sealing ring provided in the first annular groove, a front end of the sealing ring protruding at least in part beyond an outer peripheral wall of the piston, a second sealing surface being defined in a rear end surface of the sealing ring, and an outer peripheral wall of the sealing ring being abutted against an inner peripheral wall of the cylinder block in a sealed manner;

wherein, when a pressure of the front cavity is greater than that of the rear cavity, the second sealing surface is abutted against the first sealing surface in a sealed manner, and the air inlet holes are not in communication with the rear cavity; when a pressure of the front cavity is smaller than that of the rear cavity, there is a gap between the second sealing surface and the first sealing surface, and the air inlet holes are in communication with the rear cavity through the gap.

In a preferable embodiment, the sealing ring includes an inner ring and an outer ring provided at an outer periphery of the inner ring, a rear end of the inner ring is connected to a rear end of the outer ring, and a second annular groove with an opening facing forward is defined between the inner ring and the outer ring; and the second sealing surface is defined at a connection position between the inner ring and the outer ring, and the inner ring is received in the first annular groove.

In a preferable embodiment, a front end of the outer ring is more protuberant than a front end of the inner ring, and the front end of the outer ring is provided around the outer periphery of the piston.

In a preferable embodiment, a third sealing surface of the sealing ring has a convex arc surface.

In a preferable embodiment, both the rocker arm and the piston are plastic parts.

In a preferable embodiment, the rocker arm and the piston are integrally formed.

In a preferable embodiment, the front end surface of the piston is provided with a plurality of the air inlet holes at circumferential intervals.

In a preferable embodiment, the piston includes a piston body, a front end plate provided at a front end of the piston body, and a rear end plate provided at a rear end of the piston body; and outer edges of the front end plate and the rear end plate are protruded from an outer edge of the piston body to define the first annular groove in the outer periphery of the piston, the air inlet holes are provided in the front end plate, and escape grooves are provided in the piston body corresponding to the respective air inlet holes, the escape grooves communicate with the air inlet holes and the first annular groove, so that the outer edge of the piston body is wavy-shaped as a whole.

In a preferable embodiment, the drive assembly includes a motor and a cam, the cam is mounted on a power output shaft of the motor, a rear end of the rocker arm is rotatably connected to an eccentric position of the cam, and the cylinder block is connected to a housing of the motor.

In a preferable embodiment, the automobile inflatable pump further includes a mounting base which comprises a first base body and a second base body connected to each other; and the first base body is mounted on one end of the housing of the motor, the first base body is provided with a first mounting hole through which the power output shaft of the motor passes, and the cam is attached to an outer surface of the first base body; and the second base body is provided with a second mounting hole for mounting the cylinder block.

Compared with the prior art, the automobile inflatable pump according to embodiments of invention has the following beneficial effects:

In the automobile inflatable pump according to embodiments of invention, the sealing structure of the piston includes only one sealing ring. The sealing ring can not only be used to achieve a constant seal between the piston and the inner wall of the cylinder block, but also can be elastically deformed by the change in air pressure in the piston cavity during the push-and-pull process of the rocker arm, so that the sealing ring can control the opening and closing of the air inlet holes, therefore air is periodically inhaled and compressed to complete an inflation process. The automobile inflatable pump has a simple structure, can effectively improve production efficiency and reduce costs.

Figure 1:
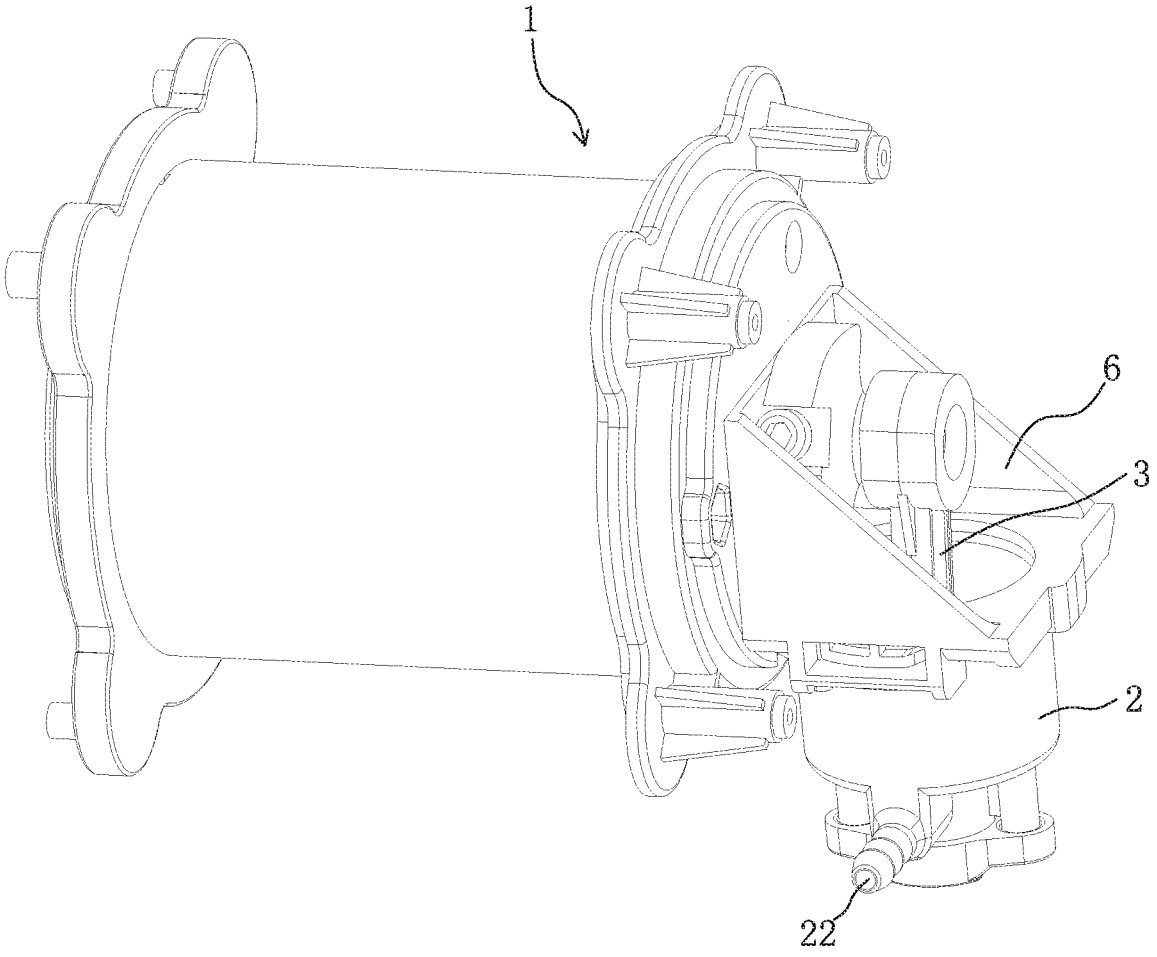
FIG. 1 is a schematic structural diagram of an automobile inflatable pump according to an embodiment of the invention.

In the figures: 1, a drive assembly; 11, a motor; 12, a cam; 2, a cylinder block; 21, a piston cavity; 211, a front cavity; 212, a rear cavity; 22, an inflation inlet; 3, a rocker arm; 4, a piston; 41, a piston body; 411, an avoidance groove; 42, a front end plate; 421, air inlet hole; 43, a rear end plate; 44, a first annular groove; 45, a first sealing surface; 5, a sealing ring; 51, a second sealing surface; 52, an inner ring; 53, an outer ring; 54, a second annular groove; 6, a mounting seat; 61, a first seat body; 611, a first mounting hole; 62, a second seat body; and 621, a second mounting hole.

DETAILED DESCRIPTION OF PREFERRED EMBODIMENTS

The specific embodiments of the invention will be further described in detail below with reference to the accompanying drawings and embodiments. The following examples are used to illustrate the invention, but not to limit the scope of the invention.

It should be understood that, in the description of the invention, the terms "first", "second", and the like, are used in the invention to describe various kinds of information. However, the information should not be limited to these terms, and these terms are only used to distinguish the same type of information from each other. For example, without departing from the scope of the invention, "first" information may also be referred to as "second" information. Similarly, the "second" information may also be referred to as the "first" information.

In addition, it should be noted that in the embodiments, when the automobile inflatable pump is used to inflate, the end closer to the inflation inlet is defined as the "front end", and the end facing away from the inflation inlet is defined as the "rear end".

As shown in FIGS. 1 to 5, this embodiment provides an automobile inflatable pump, which comprises: a drive assembly 1, a cylinder block 2, a rocker arm 3, a piston 4 and a sealing ring 5. A rear end of the rocker arm 3 is mounted on a power output end of the drive assembly 1; the cylinder block 2 is connected to the drive assembly 1, and a piston cavity 21 is defined within the cylinder block 2. The piston 4 is provided on a front end of the rocker arm 4, and is movably received in the piston cavity 21 to divide the piston cavity 21 into a front cavity 211 and a rear cavity 212. The front cavity 211 is provided with an inflation inlet 22, and the rear cavity 212 communicates with the external environment. The drive assembly 1 can drive the rocker arm 3 to rotate so that the piston 4 moves back and forth in a straight line within the piston cavity 21. An outer periphery of the piston 4 is provided with a first annular groove 44. A first sealing surface 45 is defined on a rear end surface of the first annular groove 44, and a front end surface of the piston is provided with air inlet holes communicating with the first annular groove 44. The sealing ring 5 is provided in the first annular groove 44. A front end of the sealing ring 5 protrudes at least in part beyond an outer peripheral wall of the piston 4, a second sealing surface 51 is defined on a rear end surface of the sealing ring 5, and an outer peripheral wall of the sealing ring 5 is abutted against an inner peripheral wall of the cylinder block 2 in a sealed manner.

During an inflation process, the drive assembly 1 drives the rocker arm 3 to push forward or pull back, which can change the air pressure in the front cavity 211. When the rocker arm 3 is pushed forward, the pressure in the front cavity 211 will be greater than that in the rear cavity 212, the high pressure in the front cavity 211 will act on a part of the front end of the sealing ring 5 which is more protuberant than the outer peripheral wall of the piston 4, so that the sealing ring 5 is elastically deformed, the second sealing surface 51 moves backward until it comes into contact with the first sealing surface 45 in a sealed manner, and air inlet holes 421 are not in communication with the rear cavity 212. Thus, the piston 4 compresses the air in the front cavity 211, and the compressed air is discharged from the inflation inlet 22 for inflation. When the rocker arm 3 is pulled backward and the pressure in the front cavity 211 is less than that in the rear cavity 212, the sealing ring 5 is recovered from deformed state, so that there is a gap between the second sealing surface 51 and the first sealing surfaces 45, and the air inlet holes 421 are in communication with the rear cavity 212 through the gap. Thus, air in the external environment enters the front cavity 211 through the rear cavity 212, the gap, and the air inlet holes 421 successively. The rocker arm 3 is pushed forward and pulled backwards periodically, so that air is compressed periodically and the compressed air enters a tire to be inflated, and the inflation process is completed.

Based on the above technical solution, in the automobile inflatable pump according to the embodiment of the invention, the sealing structure of the piston 4 includes only one sealing ring 5. During the entire inflation process, the sealing ring 5 can always maintain the sealing effect between the piston 4 and the inner peripheral wall of the cylinder block 2. Meanwhile, the pressure change generated in the front cavity 211 when the rocker arm 3 is pushed or pulled makes the sealing ring 5 to deform elastically, so that the sealing ring 5 can control the opening and closing of the air inlet holes 421, therefore, air is periodically inhaled and compressed to complete the inflation process. The automobile inflatable pump according to the embodiment has a simple structure and simple assembly, does not require any auxiliary tools or fixtures, which can effectively improve production efficiency, reduce production costs, and can reliably control communication and cutoff of the air inlet holes.

Figure 3:
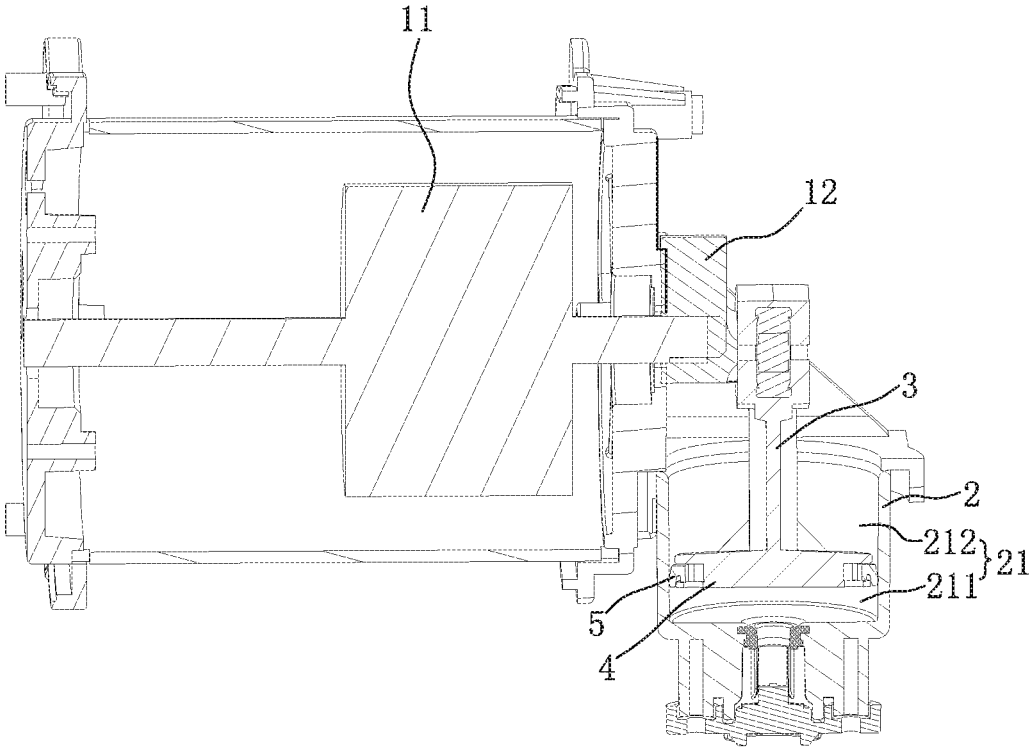
FIG. 3 is a schematic longitudinal sectional view of an inflatable pump according to an embodiment of the invention.
Figure 4:
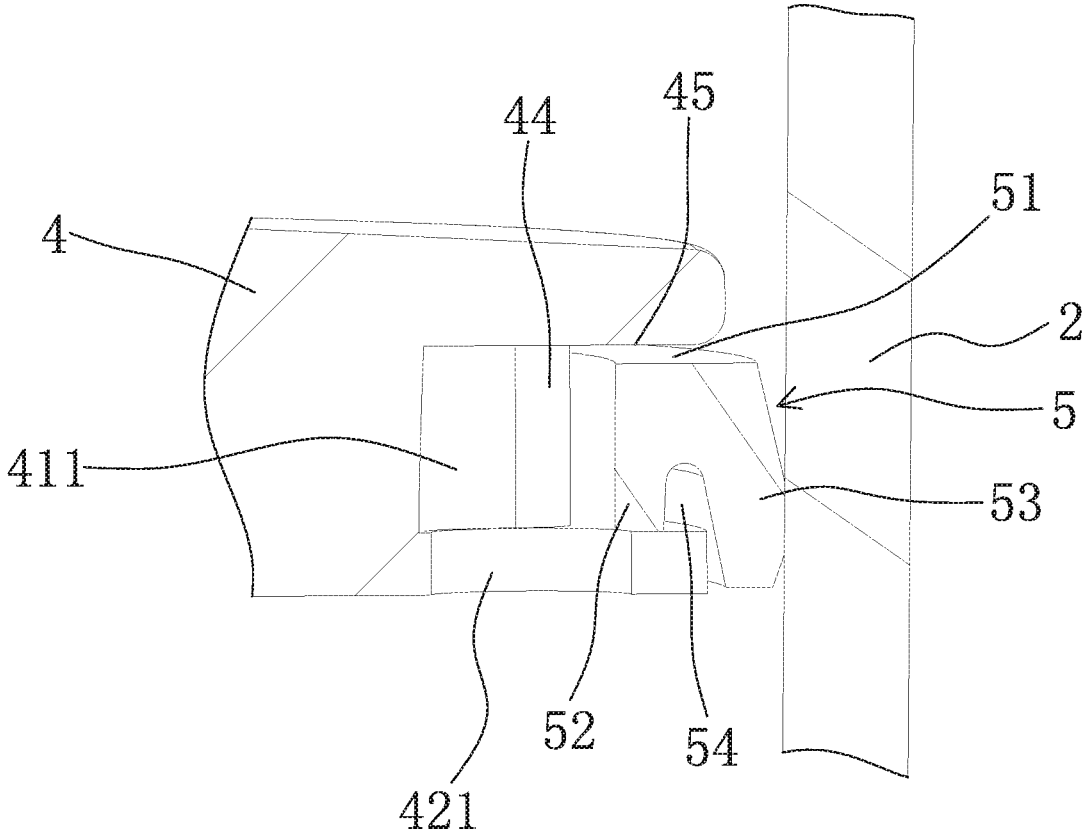
FIG. 4 is a partially enlarged schematic diagram of the fitting relationship among a piston, a seal ring and a cylinder block of the automobile inflatable pump in FIG. 3.
Figure 6:
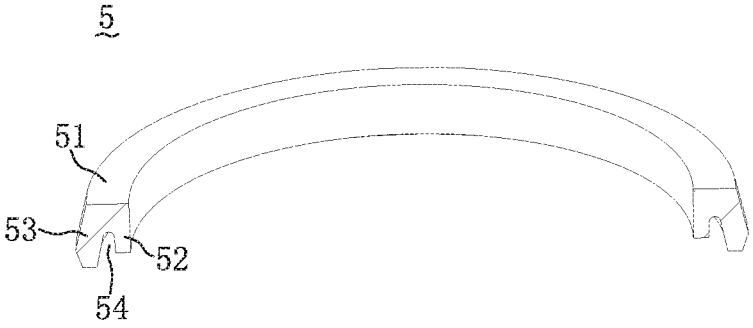
FIG. 6 is a schematic longitudinal sectional view of a sealing ring of an automobile inflatable pump according to an embodiment of the invention.

Preferably, in the embodiment, as shown in FIGS. 3, 4 and 6, the sealing ring 5 includes an inner ring 52 and an outer ring 53 provided around an outer periphery of the inner ring 52. A rear end of the inner ring 52 is connected to a rear end of the outer ring 53, and a second annular groove 54 with an opening facing forward is defined between the inner ring 52 and the outer ring 53. The second sealing surface 51 is defined at a connection between the inner ring 52 and the outer ring 53, and the inner ring 52 is received in the first annular groove 44. When the rocker arm 3 is pushed forward, the second annular groove 54 communicates with the front cavity 211, and the air pressure in the front cavity 211 increases due to compressed air, so that a high pressure acts on the front end surface of the sealing ring 5 to cause the sealing ring 5 to deform elastically, the second sealing surface 51 moves backward to abut against the first sealing surface 45 on the piston 4, and the air inlet holes 421 are in a closed state. Since the sealing rubber ring 5 is optimized structurally, the sealing ring 5 can flexibly and reliably control the opening and closing of the air inlet holes 421.

Further, in order to make the sealing ring 5 flexibly control the opening and closing of the air inlet holes 421 while it is ensured that the sealing ring 5 always keeps abutting against the inner side wall of the cylinder block 2 in a sealed manner, a front end of the outer ring 53 is more protuberant than a front end of the inner ring 52 and a front end of the outer ring 53 is provided around the outer periphery of the piston 4.

For the same objective, it is more preferable that the outer ring 53 extends gradually away from the inner ring 52 from rear to front, and the outer ring 53 is in the shape of a circular table as a whole. The sealing ring 5 is abutted against the inner wall of the cylinder block 2 through a part of a lateral wall of the outer ring 53 which is close to the front end, which can ensure a reliable sealing contact between the sealing ring 5 and the cylinder block 2. The outer ring 53 extends gradually away from the inner ring 52 from back to front, which is convenient for the sealing ring 5 to deform elastically when the air pressure changes, to control the reliable contact or separation of the second sealing surface 51 and the first sealing surface 45.

In order to facilitate to mold and reduce production costs, the rocker arm 3 and the piston 4 in the embodiment are both plastic parts, and the rocker arm 3 and the piston 4 are integrally formed.

In the embodiment, in order to further flexibly control the opening and closing of the air inlet holes during the inflation process, the front end surface of the piston 4 is provided with a plurality of the air inlet holes 421 at circumferential intervals. Exemplarily, the air inlet holes are arranged uniformly.

Figure 5:
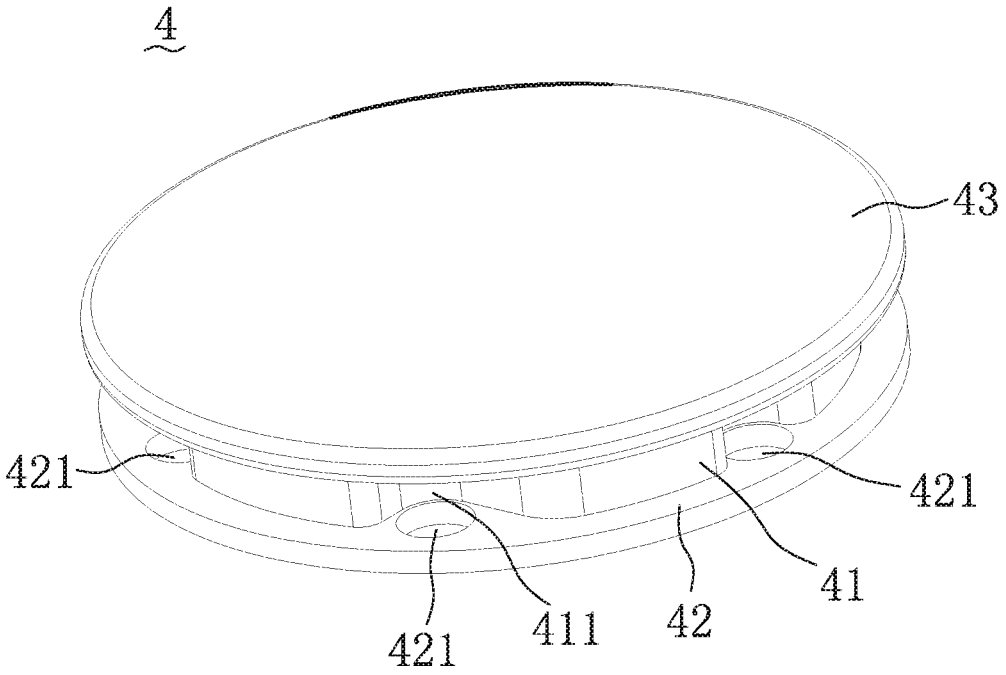
FIG. 5 is a schematic structural diagram of a piston of an automobile inflatable pump according to an embodiment of the invention.

Correspondingly, as specifically shown in FIG. 5, the piston 4 according to the embodiment includes a piston body 41, a front end plate 42 provided at a front end of the piston body 41, and a rear end plate 43 provided at a rear end of the piston body 41; outer edges of the front end plate 42 and the rear end plate 43 are more protuberant than an outer edge of the piston body 41 to define the first annular groove 44 on the outer periphery of the piston 4, the air inlet holes 421 are provided in the front end plate 42, and escape grooves 411 are provided in the piston body 41 corresponding to the respective air inlet holes 421, the escape grooves 411 communicate with the air inlet holes 421 and the first annular groove 44, so that the outer edge of the piston body 41 is wavy-shaped as a whole. The optimized structure of the piston 4 can assure that, when the second sealing surface 51 does not contact the first sealing surface 45, external air can enter the front cavity 211 through the gap between the first sealing surface and the second sealing surface, the escape grooves 411 and the air inlet holes 421, and also ensure the strength of the piston 4 and increase the service life of the piston 4.

Figure 2:
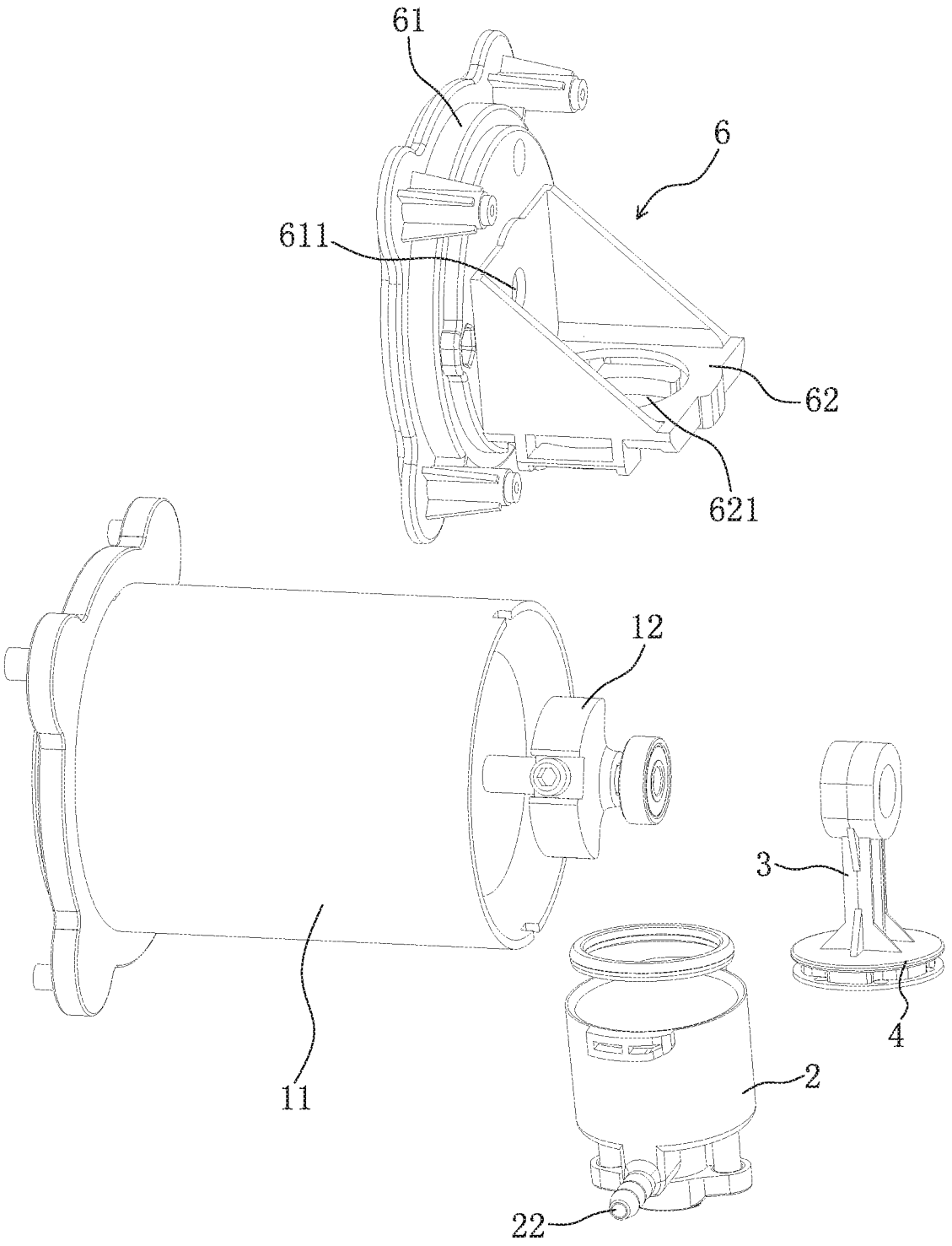
FIG. 2 is a schematic exploded diagram of an automobile inflatable pump according to an embodiment of the invention.

In the embodiment, more specifically, the drive assembly 1 includes a motor 11 and a cam 12. Specifically, as shown in FIGS. 1 to 3, the cam 12 is mounted on a power output shaft of the motor 11, the rear end of the rocker arm 3 is rotatably connected to an eccentric position of the cam 12, and the cylinder block 2 is connected to a housing of the motor 11. The motor 11 rotates to drive the cam 12 to rotate, and then drive the rocker arm 3 to rotate, so that the piston 4 at the front end of the rocker arm 3 moves back and forth in a straight line along the piston cavity 21.

Back to FIGS. 1 and 2, the automobile inflatable pump according to the embodiment further comprises a mounting base 6 which comprises a first base body 61 and a second base body 62 connected to each other. The first base body 61 is mounted on one end of the housing of the motor 11, and the first base body is provided with a first mounting hole 611 through which the power output shaft of the motor 11 passes, and the cam 12 is attached to an outer surface of the first base body 61. The second base body 62 is provided with a second mounting hole 621 for mounting the cylinder block 2. A central axis of the first mounting hole 611 is arranged to be perpendicular to a central axis of the second mounting hole 621, so that the motor 11 and the cylinder block 2 are arranged vertically.

Exemplarily, the first base body 61 and the second base body 62 in the embodiment are integrally formed.

In conclusion, in the automobile inflatable pump according to embodiment, the sealing structure of the piston includes only one sealing ring. The sealing ring can not only be used to achieve a constant seal between the piston and the inner wall of the cylinder block, but also can be elastically deformed by the change in air pressure in the piston cavity during the push-and-pull process of the rocker arm, so that the sealing ring can control the opening and closing of the air inlet holes, therefore air is periodically inhaled and compressed to complete the inflation process. The automobile inflatable pump has a simple structure, can effectively improve production efficiency and reduce costs.

The above are only preferred embodiments of the invention. It should be noted that a number of improvements and replacements can be made by those of ordinary skill in the art without departing from the technical principles of the invention. These improvements and replacements should also fall into the protection scope of the invention.

What is claimed is:

1. An automobile inflatable pump, wherein the automobile inflatable pump comprises:

a drive assembly;

a rocker arm, a rear end of which is mounted on a power output end of the drive assembly;

a cylinder block connected to the drive assembly, a piston cavity being defined within the cylinder block;

a piston provided on a front end of the rocker arm, the piston being movably received in the piston cavity to divide the piston cavity into a front cavity having an inflation inlet and a rear cavity communicating with external environment, the drive assembly driving the rocker arm to rotate so that the piston moves back and forth in a straight line, an outer periphery of the piston being provided with a first annular groove, a first sealing surface being defined on a rear end surface of the first annular groove, and a front end surface of the piston being provided with air inlet holes communicating with the first annular groove; and a sealing ring provided in the first annular groove, a front end of the sealing ring protruding at least in part beyond an outer peripheral wall of the piston, a second sealing surface being defined on a rear end surface of the sealing ring, and an outer peripheral wall of the sealing ring being abutted against an inner peripheral wall of the cylinder block in a sealed manner;

wherein the sealing ring comprises an inner ring and an outer ring which is provided around an outer periphery of the inner ring, a rear end of the inner ring is connected to a rear end of the outer ring, a second annular groove with an opening facing forward is defined between the inner ring and the outer ring, the second sealing surface is defined at a connection position between the inner ring and the outer ring, the inner ring is received in the first annular groove, a front end of the outer ring is more protuberant than a front end of the inner ring, and the front end of the outer ring is provided around the outer periphery of the piston;

wherein, when a pressure of the front cavity is greater than that of the rear cavity, the second sealing surface is abutted against the first sealing surface in a sealed manner, and the air inlet holes are not in communication with the rear cavity, the second annular groove is in communication with the front cavity, and when a pressure of the front cavity is smaller than that of the rear cavity, there is a gap between the second sealing surface and the first sealing surface, and the air inlet holes are in communication with the rear cavity through the gap.

2. The automobile inflatable pump according to claim 1, wherein the outer ring extends gradually away from the inner ring from rear to front.

3. The automobile inflatable pump according to claim 2, wherein the drive assembly includes a motor and a cam, the cam is mounted on a power output shaft of the motor, a rear end of the rocker arm is rotatably connected to an eccentric position of the cam, and the cylinder block is connected to a housing of the motor.

4. The automobile inflatable pump according to claim 3, wherein the automobile inflatable pump further comprises a mounting base which comprises a first base body and a second base body connected to each other;

the first base body is mounted on one end of the housing of the motor, the first base body is provided with a first mounting hole through which the power output shaft of the motor passes, and the cam is attached to an outer surface of the first base body; and the second base body is provided with a second mounting hole for mounting the cylinder block.

5. The automobile inflatable pump according to claim 1, wherein both the rocker arm and the piston are plastic parts.

6. The automobile inflatable pump according to claim 5, wherein the rocker arm and the piston are integrally formed.

7. The automobile inflatable pump according to claim 6, wherein the drive assembly includes a motor and a cam, the cam is mounted on a power output shaft of the motor, a rear end of the rocker arm is rotatably connected to an eccentric position of the cam, and the cylinder block is connected to a housing of the motor.

8. The automobile inflatable pump according to claim 5, wherein the drive assembly includes a motor and a cam, the cam is mounted on a power output shaft of the motor, a rear end of the rocker arm is rotatably connected to an eccentric position of the cam, and the cylinder block is connected to a housing of the motor.

9. The automobile inflatable pump according to claim 1, wherein the front end surface of the piston is provided with a plurality of the air inlet holes at circumferential intervals.

10. The automobile inflatable pump according to claim 9, wherein the piston includes a piston body, a front end plate provided at a front end of the piston body, and a rear end plate provided at a rear end of the piston body; and outer edges of the front end plate and the rear end plate are more protuberant than an outer edge of the piston body to define the first annular groove in the outer periphery of the piston, the air inlet holes are provided in the front end plate, and escape grooves are provided in the piston body corresponding to the respective air inlet holes, the escape grooves communicate with the air inlet holes and the first annular groove, so that the outer edge of the piston body is wavy-shaped as a whole.

11. The automobile inflatable pump according to claim 10, wherein the drive assembly includes a motor and a cam, the cam is mounted on a power output shaft of the motor, a rear end of the rocker arm is rotatably connected to an eccentric position of the cam, and the cylinder block is connected to a housing of the motor.

12. The automobile inflatable pump according to claim 9, wherein the drive assembly includes a motor and a cam, the cam is mounted on a power output shaft of the motor, a rear end of the rocker arm is rotatably connected to an eccentric position of the cam, and the cylinder block is connected to a housing of the motor.

13. The automobile inflatable pump according to claim 1, wherein the drive assembly includes a motor and a cam, the cam is mounted on a power output shaft of the motor, a rear end of the rocker arm is rotatably connected to an eccentric position of the cam, and the cylinder block is connected to a housing of the motor.

14. The automobile inflatable pump according to claim 13, wherein the automobile inflatable pump further comprises a mounting base which comprises a first base body and a second base body connected to each other;

the first base body is mounted on one end of the housing of the motor, the first base body is provided with a first mounting hole through which the power output shaft of the motor passes, and the cam is attached to an outer surface of the first base body; and the second base body is provided with a second mounting hole for mounting the cylinder block.

* * * * *